US008079847B2

(12) United States Patent
Davis et al.

(10) Patent No.: US 8,079,847 B2
(45) Date of Patent: Dec. 20, 2011

(54) ORTHOGONAL CONNECTOR SYSTEM WITH POWER CONNECTION

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 214 days.

(21) Appl. No.: 12/475,692

(22) Filed: Jun. 1, 2009

(65) Prior Publication Data

US 2010/0304581 A1 Dec. 2, 2010

(51) Int. Cl.
*H01R 12/00* (2006.01)

(52) U.S. Cl. ..... 439/65; 439/607.11

(58) Field of Classification Search ..... 439/65, 439/108, 607.07, 607.11
See application file for complete search history.

(56) References Cited

U.S. PATENT DOCUMENTS

| | | | | |
|---|---|---|---|---|
| 4,703,394 | A | 10/1987 | Petit et al. | |
| 5,429,521 | A | 7/1995 | Morlion et al. | |
| 6,227,882 | B1 | 5/2001 | Ortega et al. | |
| 6,347,962 | B1 | 2/2002 | Kline | |
| 6,371,773 | B1 | 4/2002 | Crofoot et al. | |
| 6,447,340 | B1 | 9/2002 | Wu | |
| 6,607,401 | B1 | 8/2003 | Weaver, Jr. et al. | |
| 6,607,402 | B2 | 8/2003 | Cohen et al. | |
| 6,717,825 | B2 | 4/2004 | Volstorf | |
| 6,746,278 | B2 * | 6/2004 | Nelson et al. | 439/607.07 |
| 6,758,695 | B2 | 7/2004 | Pepe et al. | |
| 6,780,059 | B1 | 8/2004 | Payne et al. | |
| 6,988,902 | B2 | 1/2006 | Winings et al. | |
| 7,108,556 | B2 | 9/2006 | Cohen et al. | |
| 7,331,802 | B2 * | 2/2008 | Rothermel et al. | 439/108 |
| 7,686,618 | B2 * | 3/2010 | Mizukami et al. | 439/61 |
| 2003/0119362 | A1 | 6/2003 | Nelson et al. | |
| 2004/0092140 | A1 | 5/2004 | Mashiyama et al. | |
| 2005/0148239 | A1 | 7/2005 | Hull et al. | |
| 2006/0024984 | A1 | 2/2006 | Cohen et al. | |
| 2006/0073709 | A1 | 4/2006 | Reid | |
| 2009/0149041 | A1 * | 6/2009 | Morlion et al. | 439/65 |

FOREIGN PATENT DOCUMENTS

| | | |
|---|---|---|
| EP | 1049201 | 11/2000 |
| EP | 1220361 | 7/2002 |
| EP | 1398852 | 3/2004 |
| EP | 2 209 170 A2 | 7/2010 |

OTHER PUBLICATIONS

European Search Report, EP Application No. EP 10 16 4009, International Filing Date Jun. 9, 2010.

* cited by examiner

*Primary Examiner* — Tulsidas C Patel
*Assistant Examiner* — Travis Chambers

(57) ABSTRACT

An orthogonal connector system for connecting a first circuit board and a second circuit board oriented orthogonally with respect to the first circuit board includes a receptacle assembly and a header assembly mated with the receptacle assembly. The receptacle assembly is connected to the first circuit board and the header assembly is connected to the second circuit board. The receptacle assembly and the header assembly both have a housing and contact modules held within the corresponding housing. Each contact module has a dielectric body and mating contacts extending from the dielectric body. The mating contacts of the receptacle assembly are directly connected to the mating contacts of the header assembly. Some of the mating contacts of the receptacle assembly define power contacts and at least some of the mating contacts of the receptacle assembly define power contacts configured to be mated with the power contacts of the receptacle assembly.

24 Claims, 13 Drawing Sheets

ORTHOGONAL CONNECTOR SYSTEM WITH POWER CONNECTION

BACKGROUND OF THE INVENTION

The subject matter herein relates generally to electrical connectors, and more particularly to connectors that may be mated in an orthogonal relationship.

Some electrical systems utilize electrical connectors to interconnect two circuit boards to one another. In some applications, the circuit boards may be oriented orthogonal to one another. The electrical connectors are typically right angle connectors mounted to an edge of the circuit boards. To electrically connect the right angle connectors, a midplane circuit board is provided with front and rear header connectors on opposed front and rear sides of the midplane circuit board. The midplane circuit board is orthogonal to both of the circuit boards being connected. The front header connector receives one of the right angle connectors and the rear header connector receives the other right angle connector. The front and rear header connectors each include pins that are connected to corresponding mating contacts of the right angle connectors. The pins of the front header connector are electrically connected to the pins of the rear header connector by the midplane circuit board. For example, traces are routed along and/or through the midplane circuit board to electrically connect corresponding pins with one another.

Known electrical systems that utilize right angle connectors and header connectors mounted to a midplane circuit board are not without disadvantages. For instance, known electrical systems are prone to signal degradation due to the number of mating interfaces provided between the two circuit boards that are being connected. For example, along the signal path from one circuit board to the other circuit board includes a first board interface with the first right angle connector, the mating interface between the first right angle connector and the first header connector, a board interface between the first header connector and the midplane board, another board interface between the midplane board and the second header connector, a mating interface between the second header connector and the second right angle connector, and a board interface between the second right angle connector and the second circuit board. Signal degradation is inherent at each different interface. Additionally, some signal degradation is inherent along any portion of the contacts, pins and traces defining the signal path between the two boards. The signal degradation problems are particularly noticeable at higher signal speeds. Other problems with known connector systems that utilize a midplane circuit board is the cost of the midplane circuit board and the cost of the front and rear header connectors. Costs arise from the manufacture of the components and the assembly of the components.

Some connector systems have been proposed to address the signal loss caused by transmitting signals along traces on the midplane circuit board. One such connector system eliminates the midplane circuit board altogether and utilizes a direct connection between connectors mounted on the circuit boards being interconnected. However, the configuration of the connectors is complex as the connectors are oriented orthogonal to one another. Additionally, it may be desirable to transmit power across the interface of the connectors. Creating a power path across the interface of the connectors that are arranged orthogonal to one another is difficult.

Thus, the interconnection of orthogonal circuit boards while transmitting power across the interface between the circuit boards remains a challenge.

BRIEF DESCRIPTION OF THE INVENTION

In one embodiment, an orthogonal connector system is provided for connecting a first circuit board and a second circuit board oriented orthogonally with respect to the first circuit board. The orthogonal connector system includes a receptacle assembly and a header assembly mated with the receptacle assembly. The receptacle assembly is connected to the first circuit board and the header assembly is connected to the second circuit board. The receptacle assembly and the header assembly both have a housing and contact modules held within the corresponding housing. Each contact module has a dielectric body and mating contacts extending from the dielectric body. The mating contacts of the receptacle assembly are directly connected to the mating contacts of the header assembly. At least some of the mating contacts of the receptacle assembly define power contacts configured to transmit power and at least some of the mating contacts of the header assembly define power contacts configured to be mated with the power contacts of the receptacle assembly.

In another embodiment, a connector assembly is provided for an orthogonal connector system used to interconnect circuit boards oriented orthogonally with respect to one another. The connector assembly includes a housing having a mating face and contact modules held within the housing. The contact modules each have a contact module body including a mating edge and a mounting edge that is orthogonal to the mating edge. The contact modules each have conductors held by the corresponding contact module body along a conductor plane. Contact tails extend from the conductors at the mounting edge for connection to a circuit board, and mating contacts extend from the conductors at the mating edge for mating with corresponding mating contacts of a corresponding mating connector assembly. At least one conductor of each contact module defines a power conductor configured to transmit power and at least one conductor of each contact module defines a signal contact configured to transmit data signals.

In a further embodiment, an orthogonal connector system is provided for connecting a first circuit board and a second circuit board oriented orthogonally with respect to the first circuit board. The orthogonal connector system includes a first connector assembly being connected to the first circuit board. The first connector assembly has a first connector housing, a plurality of signal contact modules held by the first connector housing, and a power contact module held by the housing. The signal contact modules have a dielectric body and first connector contacts extending from the dielectric body. The power contact module has a dielectric body and power contacts extending from the dielectric body. A second connector assembly is mated with the first connector assembly. The second connector assembly is connected to the second circuit board. The second connector assembly has a second connector housing and second connector contact modules held by the second connector housing. Each second connector contact module has a dielectric body, second connector contacts extending from the dielectric body and power contacts extending from the dielectric body. The first connector contacts are directly connected to corresponding second connector contacts, and the power contacts of the second connector contact modules are directly connected to corresponding power contacts of the power contact module. The power contact module is oriented orthogonal to the second connector contact modules.

DETAILED DESCRIPTION OF THE INVENTION

Figure 1:
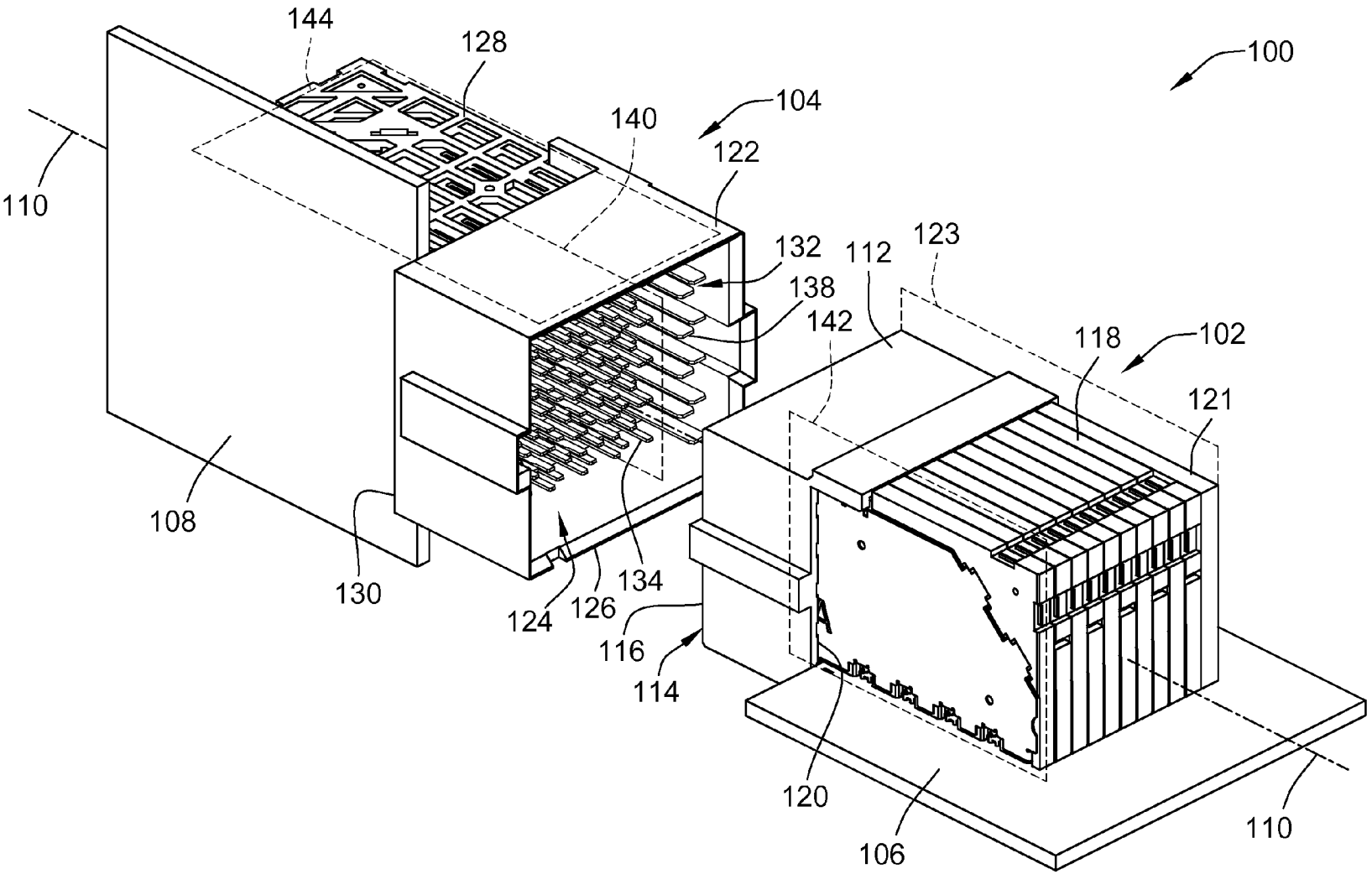
FIG. 1 is a perspective view of an orthogonal connector system formed in accordance with an exemplary embodiment illustrating a receptacle assembly and a header assembly in unmated positions.

FIG. 1 is a perspective view of an orthogonal connector system 100 formed in accordance with an exemplary embodiment illustrating two connector assemblies 102, 104 that may be directly connected to one another. The connector assemblies 102, 104 are each directly connected to first and second circuit boards 106, 108, respectively. The connector assemblies 102, 104 are configured to transfer power between the first and second circuit boards 106, 108.

The connector assemblies 102, 104 are utilized to electrically connect the first and second circuit boards 106, 108 to one another without the use of a midplane circuit board. Additionally, because the connector assemblies 102, 104 are directly connected to one another, the orthogonal connector system 100 electrically connects the first and second circuit boards 106, 108 without the use of header connectors mounted to a midplane circuit board. Only one separable mating interface is provided between the first and second circuit boards 106, 108, namely the separable mating interface between the first and second connector assemblies 102, 104. Power is transferred across the mating interface between the first and second connector assemblies 102, 104. Power is transferred between the first and second circuit boards 106, 108 without the use of separate electrical connectors mounted to the first and second circuit boards 106, 108.

The first and second circuit boards 106, 108 are orthogonal to one another and the connector assemblies 102, 104 are orthogonal to one another. For example, one of the connector assemblies 104 is turned 90° with respect to the other connector assembly 102. A mating axis 110 extends through both the first and second connector assemblies 102, 104 and the first and second connector assemblies 102, 104 are mated with one another in a direction parallel to and along the mating axis 110. In an exemplary embodiment, both the first and second circuit boards 106, 108 extend generally parallel to the mating axis 110. The orthogonal connector system 100 electrically connects the first and second circuit boards 106, 108 without the use of a circuit board oriented perpendicular to the mating axis 110 arranged between the first and second connector assemblies 102, 104.

In the illustrated embodiment, the first connector assembly 102 constitutes a receptacle assembly, and may be referred to hereinafter as receptacle assembly 102. The second connector assembly 104 constitutes a header assembly, and may be referred to hereinafter as header assembly 104. The receptacle assembly 102 is configured for mating with the header assembly 104.

It is realized that in alternative embodiments the receptacle assembly 102 and header assembly 104 may be interchanged such that the receptacle assembly 102 may be mounted to the second circuit board 108 and header assembly 104 may be mounted to the first circuit board 106. It is also realized that different types of electrical connectors may be utilized to electrically connect the first and second circuit boards 106, 108 without the use of a midplane circuit board with corresponding header connectors mounted thereto. The different types of electrical connectors may have different shapes, form factors, mating interfaces, contact arrangements, contact types and the like in alternative embodiments. The receptacle assembly 102 and header assembly 104 are merely illustrative of an exemplary embodiment of the orthogonal connector system 100.

The receptacle assembly 102 includes a housing 112 having a mating face 114 at a front 116 of the housing 112. A plurality of contact modules 118 are held by the housing 112. The contact modules 118 are loaded through a rear 120 of the housing 112. The contact modules 118 are electrically connected to the first circuit board 106. The mating face 114 is oriented orthogonal with respect to the first circuit board 106 and the mating axis 110.

At least one of the contact modules 118 includes power conductors that transfer power from the first circuit board 106 to the mating face 114. Such contact module 118 may be referred to as a power contact module 121. In the illustrated embodiment, the receptacle assembly 102 includes one contact module that defines a dedicated power contact module 121 that includes only power conductors for transferring only power through the power contact module 121. The power conductors of the power contact module 121 are aligned with one another along a power plane 123 that is parallel to each of the contact modules 118 and that is perpendicular to the first circuit board 106. The power contact module 121 represents an outer contact module along one side of the receptacle assembly 102. The power contact module 121 has the same form factor as the other contact modules 118. The power contact module 121 is loaded through the rear 120 and held by the housing 112 in a similar manner as the other contact modules 118.

The header assembly 104 includes a housing 122 having a mating face 124 at a front 126 of the housing 122. A plurality of contact modules 128 are held by the housing 122. The contact modules 128 are loaded through a rear 130 of the housing 122. The contact modules 128 are electrically connected to the second circuit board 108. The mating face 124 is oriented perpendicular with respect to the second circuit board 108 and the mating axis 110.

The housing 122 includes a chamber 132 that receives at least a portion of the receptacle assembly 102. An array of mating contacts 134 are arranged within the chamber 132 for mating with corresponding mating contacts 136 (shown in FIGS. 4 and 5) of the receptacle assembly 102. The mating contacts 134 extend from corresponding contact modules 128 into the chamber 132 when the contact modules 128 are coupled to the housing 122. The mating contacts 134 are electrically connected to the second circuit board 108 by the contact modules 128. In an alternative embodiment, the housing 112 of the receptacle assembly 102 includes a chamber that receives at least a portion of the header assembly 104 therein.

At least one of the contact modules 128 includes power conductors that transfer power from the second circuit board 108 to the mating face 124. Header power contacts 138 are associated with the power conductors and extend from corresponding contact modules 128 into the chamber 132 when the contact modules 128 are coupled to the housing 122. In the illustrated embodiment, and as will be described in further detail below, each of the contact modules 128 include at least one power conductor and associated header power contact 138 for transferring power therethrough. Each of the contact modules 128 also include signal conductors that transfer data signals therethrough and that are associated with the mating contacts 134. The power conductors and header power contacts 138 may be different than the signal conductors and signal mating contacts 134. In the illustrated embodiment, each of the power contacts 138 are arranged at the tops of the respective contact modules 128 such that each of the power contacts 138 are aligned with one another along a power plane 140. The power plane 140 is parallel to the second circuit board 108 and is perpendicular to each of the contact modules 128. The power plane 140 is aligned with the power plane 123 of the receptacle assembly 102 when the receptacle assembly 102 is mated with the header assembly 104 such that the power conductors may be electrically connected to one another by a direct connection.

The contact modules 118 of the receptacle assembly 102 are each arranged along parallel receptacle assembly contact module planes 142, one of which is shown in FIG. 1. Similarly, the contact modules 128 of the header assembly 104 are each arranged along parallel header assembly contact module planes 144, one of which is shown in FIG. 1. The receptacle assembly contact module planes 142 are oriented generally perpendicular with respect to the header assembly contact module planes 144. The receptacle assembly contact module planes 142 are oriented generally parallel with respect to the second circuit board 108. The header assembly contact module planes 144 are oriented generally parallel with respect to the first circuit board 106.

In an alternative embodiment, the power interfaces may be reversed from the arrangement illustrated in FIG. 1. For example, the receptacle assembly 102 may include a plurality of contact modules that each include power contacts and signal contacts. The header assembly 104 may include a dedicated power contact module having only power contacts for mating with the power. As such, the power plane of the receptacle assembly 102 is perpendicular to the planes defined by the contact modules of the receptacle assembly 102 and the power plane of the header assembly 104 is parallel to the planes defined by the contact modules of the header assembly 104.

Figure 2:
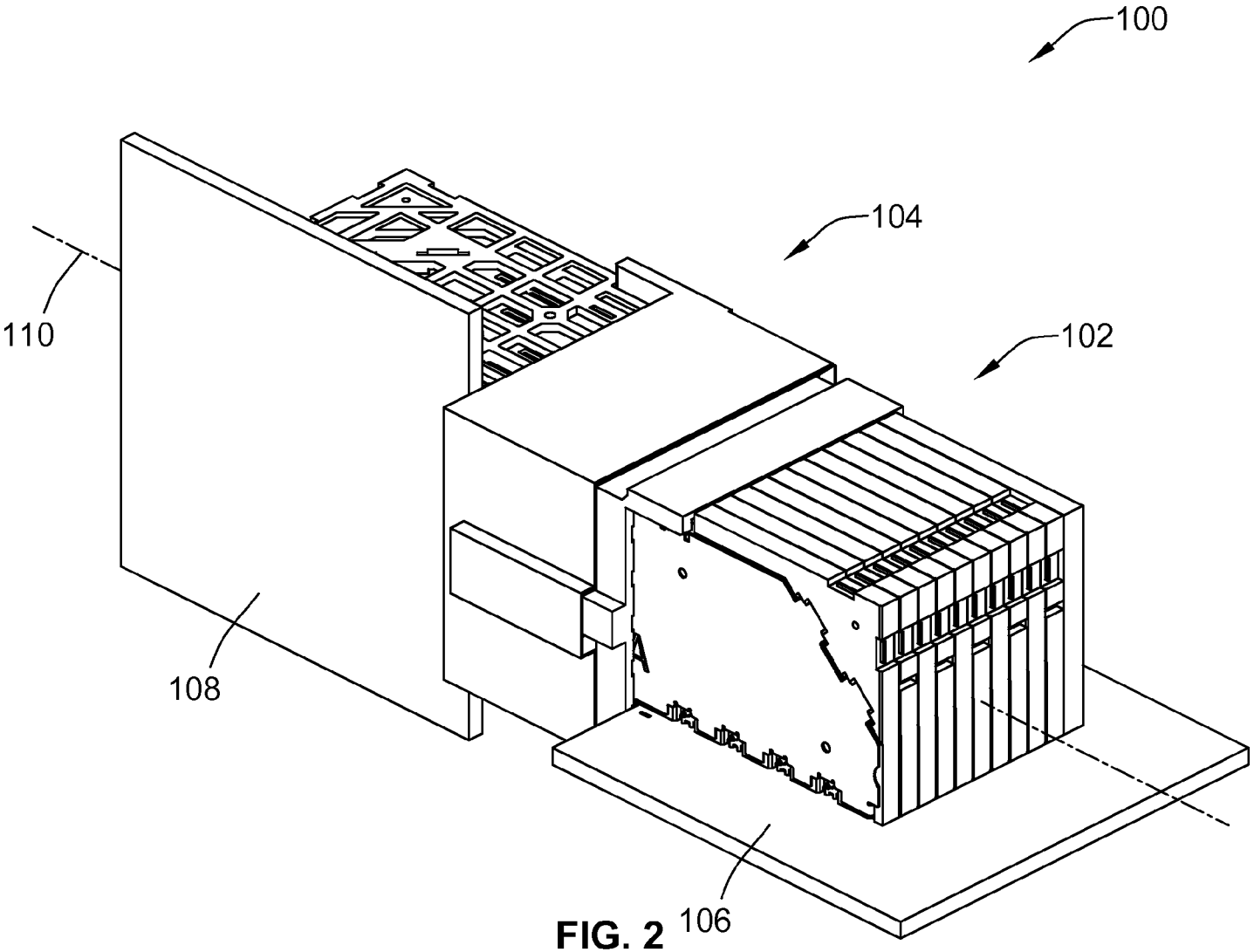
FIG. 2 is a perspective view of the orthogonal connector system shown in FIG. 1 with the receptacle assembly and the header assembly in a mated position.

FIG. 2 is a perspective view of the orthogonal connector system 100 in a mated position. During mating, at least one of the receptacle assembly 102 and header assembly 104 are moved towards the other along the mating axis 110 until the receptacle assembly 102 and header assembly 104 are mated with one another. When mated, an electrical connection is established between the receptacle assembly 102 and header assembly 104, and a corresponding electrical connection is established between the first and second circuit boards 106, 108. When mated, both power and data signals may be transmitted across the interface between the receptacle and header assemblies 102, 104. Power may be supplied to either the first circuit board 106 or the second circuit board 108 from an external source, and the power may be transferred to the other circuit board 106, 108 by the connector assemblies 102, 104. Optionally, either the receptacle assembly 102 or the header assembly 104 may be in a fixed position and only the other of the receptacle assembly 102 and the header assembly 104 is moved along the mating axis 110 in a mating direction. For example, the header assembly 104 may be fixed within an electronic device such as a host device, a computer, a network switch, a computer server and the like, while the receptacle assembly 102 may be part of an external device being electrically connected to the electronic device, or vice versa.

Figure 3:
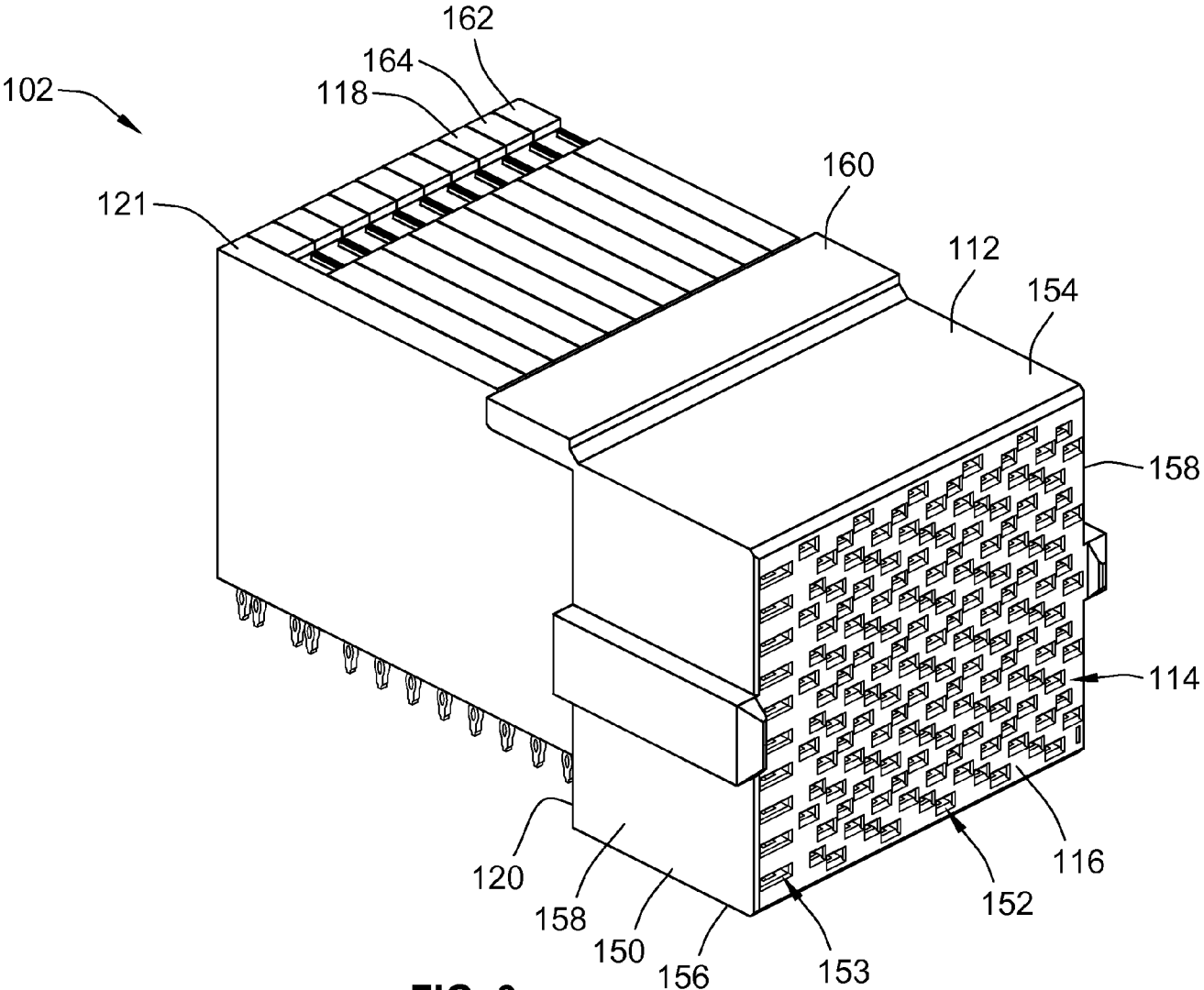
FIG. 3 is a front perspective view of the receptacle assembly shown in FIG. 1.

FIG. 3 is a front perspective view of the receptacle assembly 102 illustrating the contact modules 118 and the power contact module 121 coupled to the housing 112. The housing 112 includes a base 150 extending between the front 116 and the rear 120. A plurality of contact channels 152 extend through the base 150. The contact channels 152 receive the mating contacts 136 (shown in FIG. 4). A plurality of power channels 153 extend through the base 150. The power channels 153 receive power contacts 276 (shown in FIG. 6). Optionally, each of the power channels 153 may be aligned with one another in a column. The contact channels 152 and power channels 153 are arranged in a pattern that complements the pattern of receptacle mating contacts 136 and receptacle power contacts 276.

The base 150 includes a top 154 and a bottom 156. The base 150 includes opposed sides 158 that extend between the top 154 and the bottom 156. A shroud 160 extends rearward from the rear 120 of the housing 112. The shroud 160 may be used to guide and/or hold the contact modules 118 and/or the power contact module 121. The contact modules 118 and the power contact module 121 are coupled to the rear 120 of the housing 112. Optionally, at least a portion of the contact modules 118 and the power contact module 121 may be loaded into the rear 120 and secured thereto.

In an exemplary embodiment, multiple contact modules 118 are used in addition to the power contact module 121. Each of the contact modules 118 may be identical to one another, or alternatively different types of contact modules 118 may be used. For example, in the illustrated embodiment, two different types of contact modules 118 are utilized, namely "A" type contact modules 162 and "B" type contact modules 164. The contact modules 162, 164 are arranged in an alternating sequence with five "A" type contact modules 162 and five "B" type modules 164. While ten contact modules 118 are illustrated, any number of contact modules 118 may be utilized. Additionally, more than two types of contact modules 118 may be used, and the different types of contact modules 118 may be used in any order depending on the particular application. The power contact module 121 may be positioned at any location among the contact modules 118, and in the illustrated embodiment, is positioned as an outermost module within the group of modules.

Figure 4:
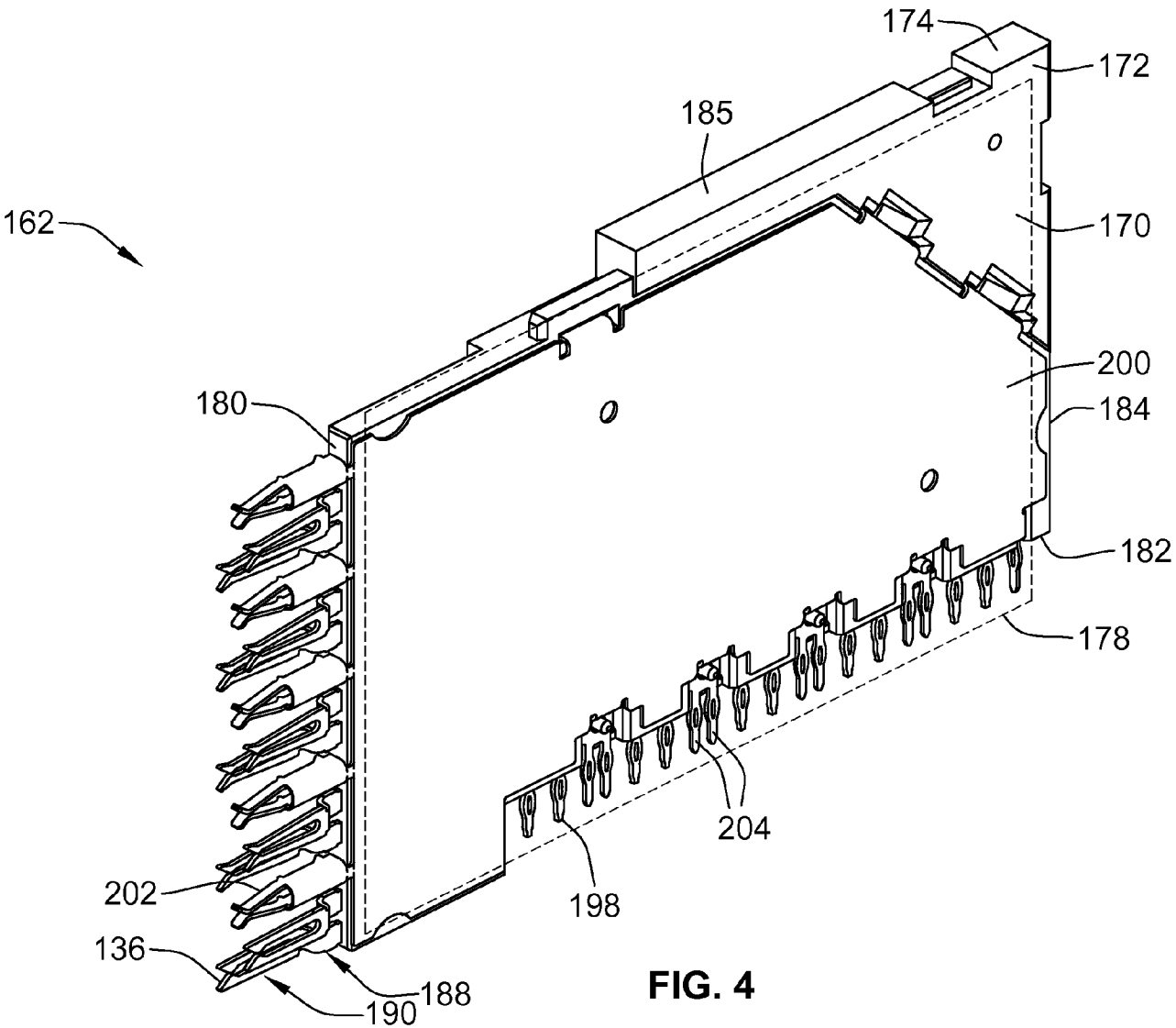
FIG. 4 is a front perspective view of a first type of contact module for the receptacle assembly shown in FIG. 3.

FIG. 4 is a front perspective view of an "A" type of contact module 162 for the receptacle assembly 102 (shown in FIG. 3). In an exemplary embodiment, the contact module 162 may be similar to the contact module described in U.S. patent application titled ORTHOGONAL CONNECTOR SYS- TEM, having Ser. No. 12/353,550, the complete subject matter of which is herein incorporated by reference. The contact module 162 includes a contact module body 170 having opposed sides 172, 174. The contact module body 170 holds a plurality of conductors (not shown) therein. In an exemplary embodiment, the conductors are formed from a lead frame and the contact module body 170 is overmolded around the conductors. Alternatively, individual contacts representing the conductors are positioned within the contact module body 170. The conductors extend along and define a conductor plane 178 within the contact module body 170. The conductor plane 178 extends parallel to the sides 172, 174 of the contact module body 170. Optionally, the conductor plane 178 may be substantially centered between the sides 172, 174.

The contact module body 170 includes a forward mating edge 180 and a bottom mounting edge 182 that is orthogonal to the mating edge 180. The contact module body 170 also includes a rear edge 184 opposite the mating edge 180 and a top edge 185 opposite the mounting edge 182.

The conductors generally extend between the mating edge 180 and the mounting edge 182 along the conductor plane 178. The mating contacts 136 are electrically connected to corresponding conductors and extend through the mating edge 180. Optionally, the mating contacts 136 may be integrally formed with the conductors as part of the lead frame. The mating contacts 136 may be signal contacts, ground contacts, power contacts and the like. In the illustrated embodiment, the mating contacts 136 are signal contacts configured to carry data signals. The mating contacts 136 may be arranged in pairs and the mating contacts 136 may carry differential pair signals In an exemplary embodiment, the mating contacts 136 are offset out of the conductor plane 178. The mating contacts 136 include a transition portion 188 forward of the mating edge 180 of the contact module body 170. The mating contacts 136 include a mating portion 190 forward of the transition portion 188. The transition portion 188 transitions the mating contact 136 out of the conductor plane 178. For example, the transition portion 188 may be curved or bent such that the mating portion 190 is non-coplanar with the conductor plane 178. Optionally, the transition portion 188 may be curved or bent such that the mating portion 190 is parallel to the conductor plane 178. In an exemplary embodiment, the mating portion 190 is generally aligned with one of the sides 172, 174 of the contact module body 170. Optionally, the mating portions 190 of adjacent mating contacts 136 may be arranged on opposite sides of the conductor plane 178. For example, the mating contacts 136 within a pair may be offset in opposite directions. In the illustrated embodiment, the mating contacts 136 are tuning-fork style contacts with a pair of beams separated by a gap.

The contact module 118 includes a plurality of contact tails 198. The contact tails 198 are electrically connected to corresponding conductors and extend through the mounting edge 182. Optionally, the contact tails 198 may be integrally formed with the conductors as part of the lead frame. In an exemplary embodiment, the contact tails 198 are generally coplanar with the conductor plane 178. The contact tails 198 may be eye-of-the-needle type contacts that fit into vias in the circuit board 106. Other types of contacts may be used for through hole mounting or surface mounting to the circuit board 106.

A shield 200 is coupled to the contact module 162. The shield 200 may be designed specifically for a particular type of contact module, such as the "A" type contact module 162, and may not be used with other types of contact modules, such as the "B" type contact module 164 (shown in FIG. 3). However, the shield 200 may be designed to be used with more than one type of contact module 162 or 164 in alternative embodiments. The shield 200 includes shield mating contacts 202 that extend forwardly and shield tails 204 that extend downwardly. The shield mating contacts 202 may extend into corresponding contact channels 152 (shown in FIG. 3) for mating engagement with corresponding shield mating contacts of the header assembly 104. The shield tails 204 may include one or more eye-of-the-needle type contacts that fit into vias in the circuit board 106. Other types of contacts may be used for through hole mounting or surface mounting to the circuit board 106.

The pattern of mating contacts 136 and shield mating contacts 202 complement one another such that the shield mating contacts 202 are positioned between adjacent pairs of mating contacts 136. The pattern of contact tails 198 and shield tails 204 complement one another such that the shield tails 204 are positioned between adjacent pairs of contact tails 198. The contact module 162 and the shield 200 have a repeating signal-signal-ground contact pattern.

Figure 5:
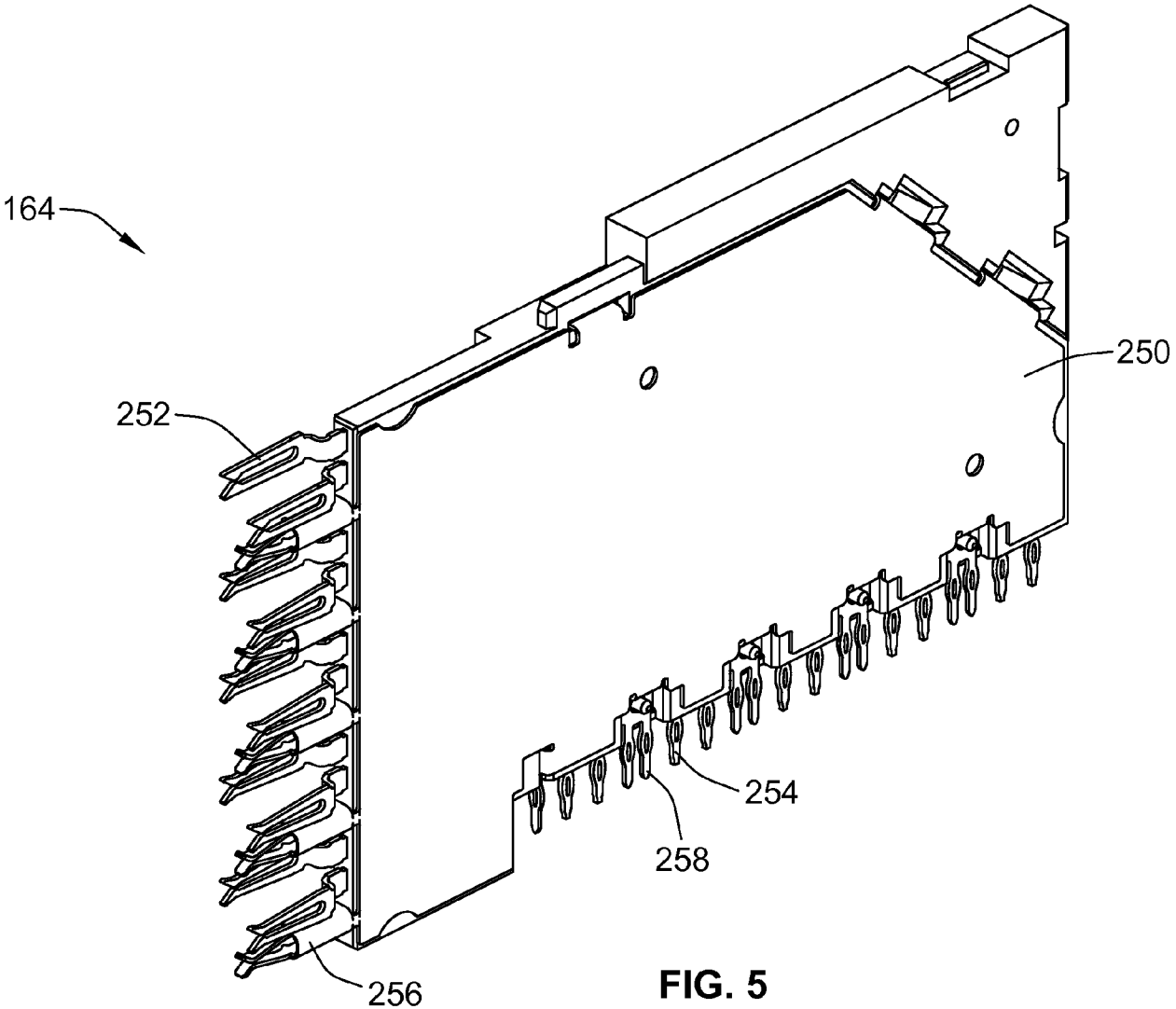
FIG. 5 is a front perspective view of a second type of contact module for the receptacle assembly shown in FIG. 3.

FIG. 5 is a front perspective view of a "B" type of contact module 164 for the receptacle assembly 102 (shown in FIG. 3). A shield 250 is coupled to the contact module 164. The contact module 164 may be substantially similar to the contact module 162 shown in FIG. 3, however the arrangement and pattern of mating contacts 252 and contact tails 254 may be different than the arrangement and pattern of mating contacts 136 (shown in FIG. 4) and contact tails 198 (shown in FIG. 4). Similarly, the shield 250 may be substantially similar to the shield 200 (shown in FIG. 3), however the arrangement and pattern of shield mating contacts 256 and shield tails 258 may be different than the arrangement and pattern of shield mating contacts 202 (shown in FIG. 4) and shield tails 204 (shown in FIG. 4).

The shield 250 is coupled to the contact module 164 such that the shield mating contacts 256 are arranged between adjacent pairs of mating contacts 252 and such that the shield tails 258 are arranged between adjacent pairs of contact tails 254. The mating contacts 252 and the shield mating contacts 256 have a repeating ground-signal-signal contact pattern from a bottom to a top, which is different than the signal-signal-ground contact pattern of the type "A" contact module 162. The contact tails 254 and the shield tails 258 have a repeating ground-signal-signal contact pattern from a front to a rear, which is different than the signal-signal-ground contact pattern of the type "A" contact module 162.

When the receptacle assembly 102 is assembled, the contact modules 162, 164 are positioned adjacent one another. The different contact patterns of the contact modules 162, 164 stagger the positions of the signal paths (e.g. the signal path may be defined by the mating contact, the conductor and/or the contact tail) such that one or more signal paths within the contact module 164 are misaligned or not aligned with a signal path of an adjacent contact module 162. The overall electrical performance of the receptacle assembly 102, which utilizes two types of contact modules 162, 164, may be enhanced as compared to a receptacle assembly that utilizes contact modules that are identical.

Figure 6:
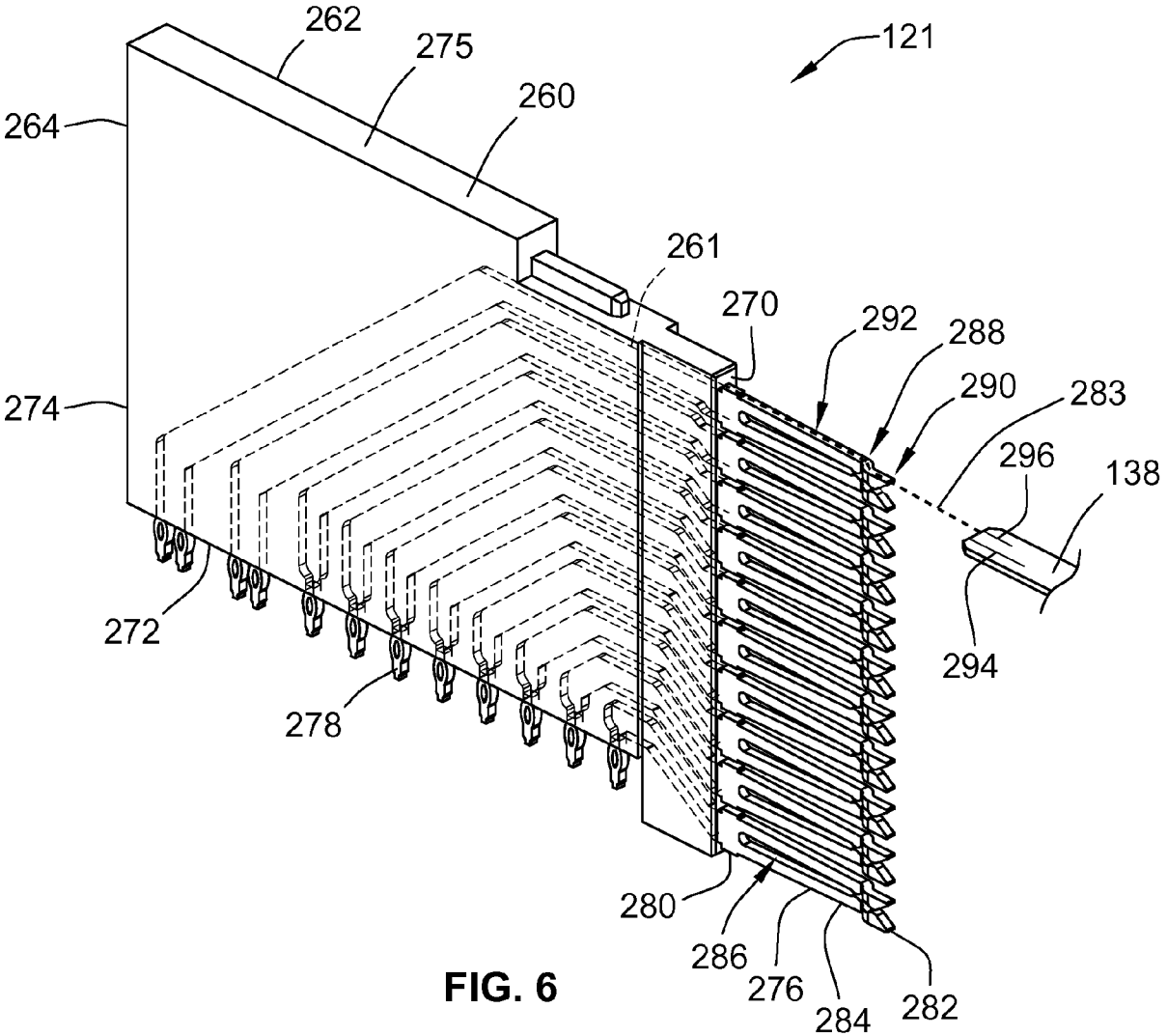
FIG. 6 is a front perspective view of a third type of contact module for the receptacle assembly shown in FIG. 3.

FIG. 6 is a front perspective view of the power contact module 121 for the receptacle assembly 102 (shown in FIG. 3). The power contact module 121 includes a contact module body 260 having opposed sides 262, 264. The contact module body 260 holds a plurality of conductors 261 (shown in phantom) therein. In an exemplary embodiment, the conductors 261 are formed from a lead frame and the contact module body 260 is overmolded around the conductors 261. Alternatively, individual contacts representing the conductors 261 are positioned within the contact module body 260. The conductors 261 extend along and define the power plane 123 within the contact module body 260. The power plane 123 extends parallel to the sides 262, 264 of the contact module body 260. Optionally, the power plane 123 may be substantially centered between the sides 262, 264.

The contact module body 260 includes a forward mating edge 270 and a bottom mounting edge 272 that is orthogonal to the mating edge 270. The contact module body 260 also includes a rear edge 274 opposite the mating edge 270 and a top edge 275 opposite the mounting edge 272.

Power contacts 276 extend from the mating edge 270 and power tails 278 extend from the mounting edge 272. The conductors 261 generally extend between the power contacts 276 and the power tails 278 along the power plane 123. Optionally, the power contacts 276 may be integrally formed with the conductors 261 as part of the lead frame. As such, the power contacts 276 define an exposed portion of the power conductors 261. The power contacts 276 are configured to be mated with the header power contacts 138 (one of which is shown in phantom in FIG. 6) to transfer power between the receptacle assembly 102 and the header assembly 102 (both shown in FIG. 1). Any number of power contacts 276 may be provided with the contact module 121. The power contacts 276 are aligned with one another along the power plane 123. Optionally, the power contacts 276 may have different lengths for sequenced mating.

The power contacts 276 extend between a base 280 and a tip 282 along a power contact axis 283. In an exemplary embodiment, the power contacts 276 constitute tuning-fork style contacts with a pair of beams 284 separated by a gap 286. The header power contacts 138 are received within the gap 286. Other types of contacts may be used in alternative embodiments.

Optionally, the power contacts 276 have jogged sections 288 between the bases 280 and the tips 282. The jogged sections 288 force the tips 282 out of plane with respect to the bases 280 such that the power contacts 276 are non-planar along the power contact axis 283. The power contacts 276 define a forward mating portion 290 forward of the jogged sections 288 and a rearward mating portion 292 rearward of the jogged sections 288. The forward mating portion 290 is off-set with respect to the rearward mating portion 292. The forward mating portion 290 engages the header power contact 138 along a first mating line 294 and the rearward mating portion 292 engages the header power contact 138 along a second mating line 296.

During mating or unmating, arcing or sparking may occur between the power contacts 276 and the header power contacts 138. When arcing occurs, the power contact 276 and/or the header power contact 138 may be negatively impacted. For example, the contacts may be degraded, pitted or burned at the interface. The contacts may turn black and be covered with a film. Plating at the interface may be removed. The forward mating portion 290 and the portion of the header power contact 138 along the first mating line 294 may be sacrificial so that the final mating between the contacts along the rearward mating portion 292 and the second mating line 296 may be un-affected by arcing. The degradation is limited to the forward mating portion 290 and the portion of the header power contact 138 along the first mating line 294. As such, the rearward mating portion 292 and the second mating line 296 remain clean and un-degraded.

The power tails 278 are electrically connected to corresponding conductors 261 and extend through the mounting edge 272. Optionally, the power tails 278 may be integrally formed with the conductors 261 as part of the lead frame. As such, the power tails 278 define an exposed portion of the power conductors 261. Optionally, more than one power tail 278 may be integrally formed with each power conductor 261. As such, more power may be transferred across the interface between the power tails 278 and the circuit board 106 (shown in FIG. 1). For example, higher current or higher voltage may be transferred across the interface. Optionally, at least some of the conductors 261 may be wider and define higher power conductors capable of transferring higher current or higher voltage.

Figure 7:
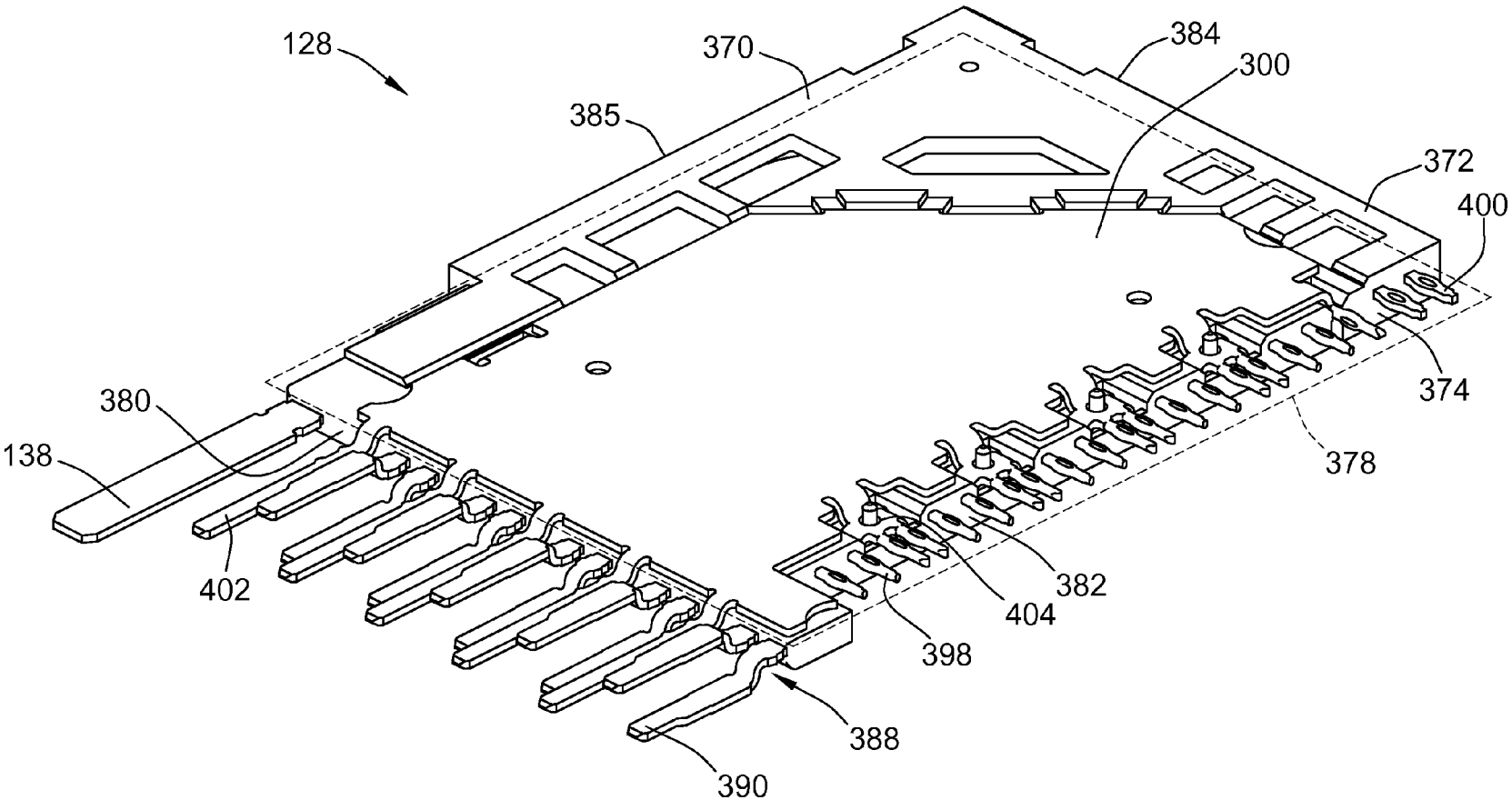
FIG. 7 is a front perspective view of a first type of contact module for the header assembly shown in FIG. 1.

FIG. 7 is a front perspective view of the contact module 128 and a shield 300 for the header assembly 104 (shown in FIG. 1). Multiple contact modules 128 are used with the header assembly 104. Each of the contact modules 128 may be identical to one another, or alternatively different types of contact modules 128 may be used. For example, FIG. 7 illustrates one type of contact module, namely an "A" type of contact module. Another type of contact module, namely a "B" type of contact module 302 (shown in FIG. 8) may also be used within the header assembly 104. The contact modules 128, 302 may be arranged in an alternating sequence. Any number of contact modules 128 or 302 may be utilized. Additionally, more than two types of contact modules may be used, and the different types of contact modules may be used in any order depending on the particular application.

The shield 300 is coupled to the contact module 128. The shield 300 may be grounded to the second circuit board 108 (shown in FIG. 1) and/or the receptacle assembly 102 (shown in FIG. 1). Optionally, the contact module 128 may be utilized without the corresponding shield 300. The contact module 128 may designed to be shieldless by incorporating at least some of the features of the shield, such as the shield mating contacts and shield tails described below.

The contact module 128 includes a contact module body 370 having opposed sides 372, 374. The contact module body 370 holds a plurality of conductors 376 (shown in FIG. 9) therein. In an exemplary embodiment, the conductors 376 are formed from a lead frame 377 (shown in FIG. 9) and the contact module body 370 is overmolded around the conductors 376. Alternatively, individual contacts representing the conductors 376 are positioned within the contact module body 370. The conductors 376 extend along and define a conductor plane 378 within the contact module body 370. The conductor plane 378 extends parallel to the sides 372, 374 of the contact module body 370. Optionally, the conductor plane 378 may be substantially centered between the sides 372, 374.

The contact module body 370 includes a forward mating edge 380 and a bottom mounting edge 382 that is orthogonal to the mating edge 380. The contact module body 370 also includes a rear edge 384 opposite the mating edge 380 and a top edge 385 opposite the mounting edge 382.

The conductors 376 generally extend between the mating edge 380 and the mounting edge 382 along the conductor plane 378. The mating contacts 134 are electrically connected to corresponding conductors 376 and extend through the mating edge 380. Optionally, the mating contacts 134 may be integrally formed with the conductors 376 as part of the lead frame 377. As such, the mating contacts 134 define an exposed portion of the conductors 376. The mating contacts 134 constitute signal contacts configured to carry data signals. The mating contacts 134 may be arranged in pairs and the mating contacts 134 may carry differential pair signals.

The header power contact 138 extends from the mating edge 380. While only one header power contact 138 is illustrated, it is realized that any number of header power contacts 138 may be provided with the contact module 128. The header power contact 138 is longer than the mating contacts 134. As such, the header power contact 138 is mated prior to the mating contacts 134 when the header assembly 104 is mated with the receptacle assembly 102 (shown in FIG. 1). The header power contact 138 is wider than the mating contacts 134. The width of the header power contact 138 may be selected based on the amount of power transmitted through the contact module 128. For example, the header power contact 138 may be wider for higher voltage or current applications or may be narrower for lower voltage or current applications. In an exemplary embodiment, the header power contact 138 constitutes a blade type contact that is generally planar and rectangular in shape. Other types of contacts may be used in alternative embodiments.

The mating contacts 134 and the header power contact 138 are arranged in a predetermined pattern. The pattern complements the arrangement of the mating contacts 136 and power contacts 276 of the receptacle assembly 102 such that the mating contacts 136, 134 may be electrically connected to one another and the header power contact 138 may be electrically connected to the corresponding power contact 276. As described above, different types of contact modules 128 may have mating contacts 134 arranged differently. For example, the "B" type contact modules 302 (shown in FIG. 8) may have a different arrangement of mating contacts 134 and header power contact 138 than the "A" type contact module 128 illustrated in FIG. 7. In the illustrated embodiment, the header power contact 138 is positioned proximate to the top edge 385, however the location of the header power contact 138 may be different in alternative embodiments.

In an exemplary embodiment, the mating contacts 134 are offset out of the conductor plane 378. The mating contacts 134 include a transition portion 388 forward of the mating edge 380 of the contact module body 370. The mating contacts 134 include a mating portion 390 forward of the transition portion 388. The transition portion 388 transitions the mating contact 134 out of the conductor plane 378. For example, the transition portion 388 may be curved or bent such that the mating portion 390 is non-coplanar with the conductor plane 378. Optionally, the transition portion 388 may be curved or bent such that the mating portion 390 is parallel to the conductor plane 378. In an exemplary embodiment, the mating portion 390 is generally aligned with one of the sides 372, 374 of the contact module body 370. Optionally, the mating portions 390 of adjacent mating contacts 134 may be arranged on opposite sides of the conductor plane 378. For example, the mating contacts 134 within a pair may be offset in opposite directions. The header power contact 138 is generally coplanar with the conductor plane 378, however, the header power contact 138 may be offset on one side or the other of the conductor plane 378.

The contact module 128 includes a plurality of contact tails 398. The contact tails 398 are electrically connected to corresponding conductors 376 and extend through the mounting edge 382. Optionally, the contact tails 398 may be integrally formed with the conductors 376 as part of the lead frame 377. As such, the contact tails 398 define an exposed portion of the conductors 376. The contact module 128 also includes one or more a power contact tails 400. The power contact tails 400 are electrically connected to the power conductor and extend through the mounting edge 382. Optionally, the power contact tails 400 may be integrally formed with the power conductor as part of the lead frame 377. More than one power contact tail 400 may be integrally formed with the power conductor.

The shield 300 includes shield mating contacts 402 that extend forwardly and shield tails 404 that extend downwardly. The shield mating contacts 402 are configured for mating engagement with corresponding shield mating contacts of the receptacle assembly 102. The shield tails 404 may include one or more eye-of-the-needle type contacts that fit into vias in the circuit board 108. Other types of contacts may be used for through hole mounting or surface mounting to the circuit board 108. The mating contacts 134 and the shield mating contacts 402 have a repeating signal-signal-ground contact pattern from a bottom to a top of the contact module 128. The contact tails 398 and the shield tails 404 have a repeating signal-signal-ground contact pattern from a front to a rear of the contact module 128.

As described above, the contact module 128 may be used without the shield 300. In such embodiments, the shield mating contacts 402 and the shield tails 404 may be part of the contact module 128. Additionally, the shield mating contacts 402 and the shield tails 404 may be interconnected by conductors that are part of the lead frame 377 and held by the contact module body 370.

Figure 8:
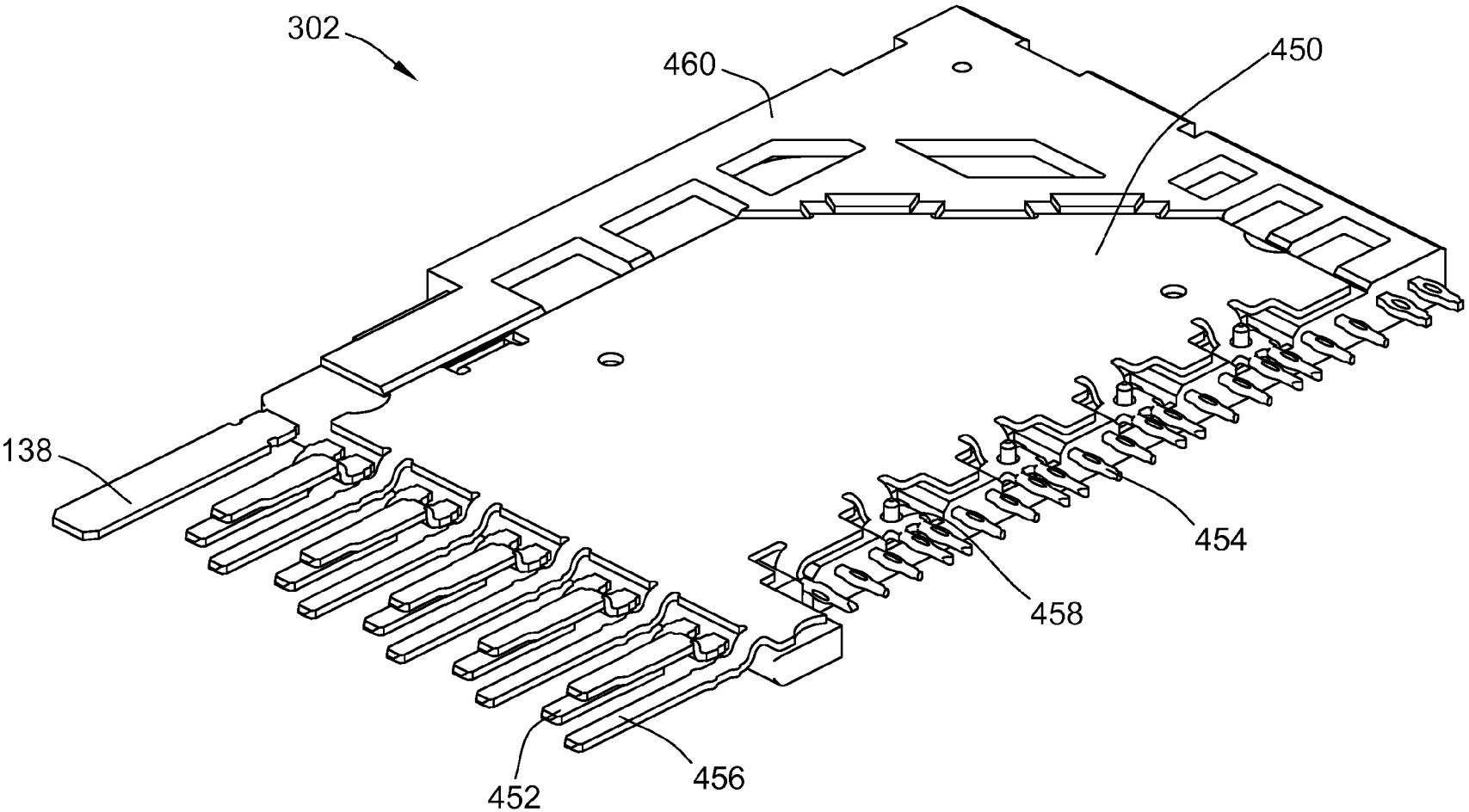
FIG. 8 is a front perspective view of a second type of contact module for the header assembly shown in FIG. 1.

FIG. 8 is a bottom perspective view of the "B" type contact module 302 and a shield 450 for the header assembly 104 (shown in FIG. 1). The contact module 302 may be substantially similar to the contact module 128 shown in FIG. 10), however the arrangement and pattern of mating contacts 452 and contact tails 454 may be different than the arrangement and pattern of mating contacts 134 (shown in FIG. 10) and contact tails 398 (shown in FIG. 10). Similarly, the shield 450 may be substantially similar to the shield 300 (shown in FIG. 10), however the arrangement and pattern of shield mating contacts 456 and shield tails 458 may be different than the arrangement and pattern of shield mating contacts 416 (shown in FIG. 10) and shield tails 418 (shown in FIG. 10). Similar to the contact module 128, the contact module 302 includes one of the header power contacts 138. The header power contact 138 of the contact module 302 may be substantially similar to the header power contact 138 of the contact module 128. Alternatively, the header power contact 138 of the contact module 302 may be different than the header power contact 138 of the contact module 128, such as by being a different size, shape, type, in a different location, and the like.

The shield 450 is coupled to a contact module body 460 of the contact module 302 such that the shield mating contacts 456 are arranged between adjacent pairs of mating contacts 452 and such that the shield tails 458 are arranged between adjacent pairs of contact tails 454. The mating contacts 452 and the shield mating contacts 456 have a repeating ground-signal-signal contact pattern from a bottom to a top, which is different than the signal-signal-ground contact pattern of the type "A" contact module 128. The contact tails 454 and the shield tails 458 have a repeating ground-signal-signal contact pattern from a front to a rear, which is different than the signal-signal-ground contact pattern of the type "A" contact module 128.

Figure 9:
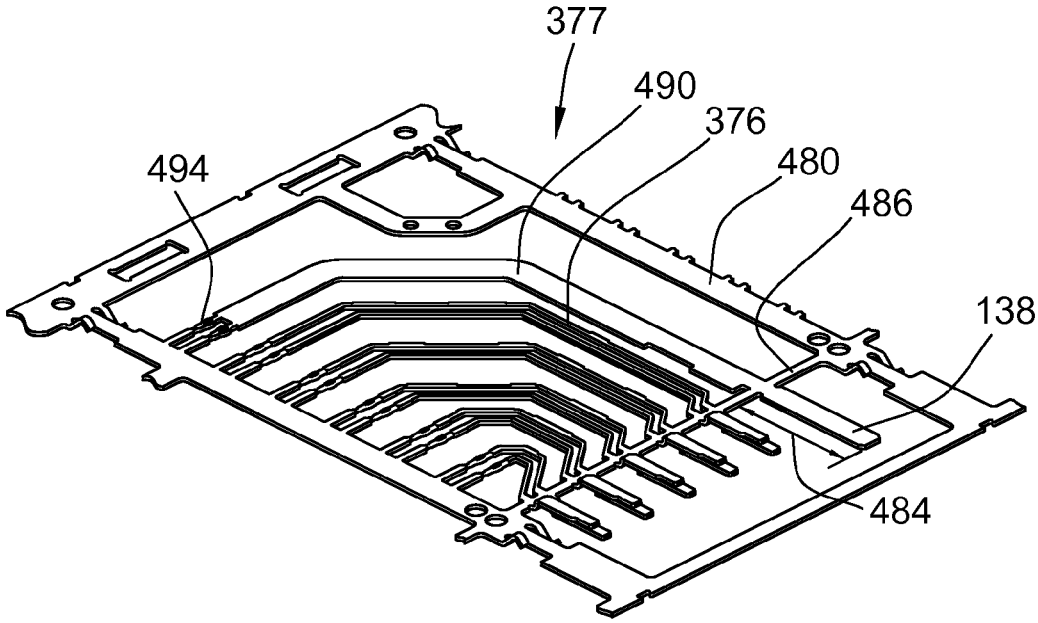
FIG. 9 is a perspective view of a lead frame for the first type of contact module shown in FIG. 7.
Figure 10:
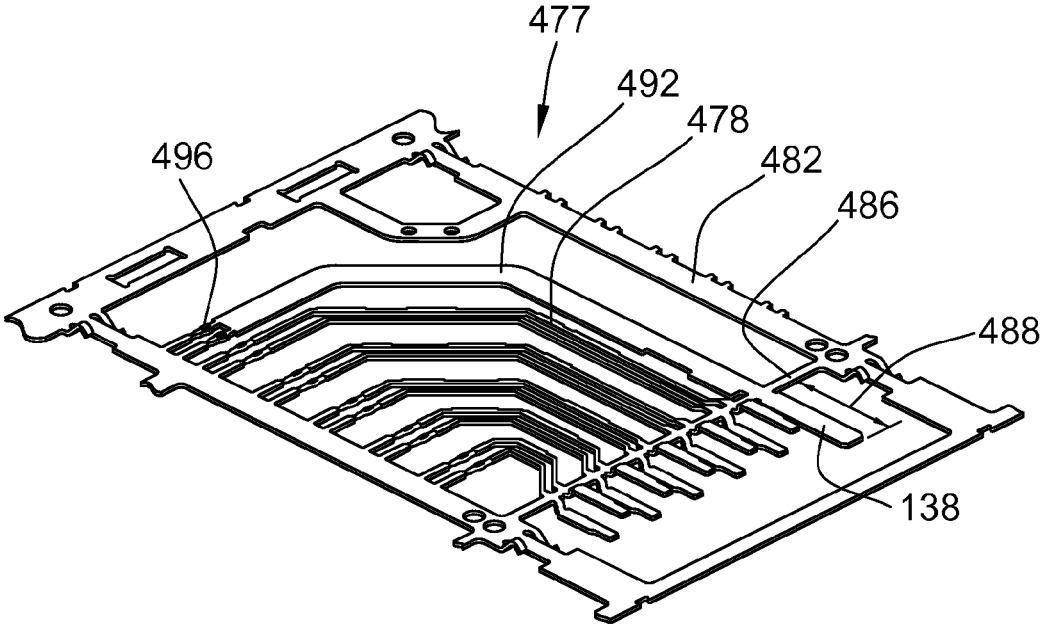
FIG. 10 is a perspective view of a lead frame for the second type of contact module shown in FIG. 8.

FIGS. 9 and 10 illustrate lead frames 377, 477 of the contact modules 128, 302, respectively. The lead frames 377, 477 are similar to one another, however, the lead frames 377, 477 have different arrangements and/or configurations of conductors 376, 478, respectively. The lead frames 377, 477 are carried by carriers 480, 482, respectively. The contact module bodies 370, 460 (shown in FIGS. 8 and 9, respectively) are overmolded around the conductors 376, 478 to secure the conductors 376, 478 in place. The conductors 376, 478 are severed from the carriers 480, 482 after overmolding the contact module bodies 370, 460. Optionally, the contact module bodies 370, 460 may be formed in more than one overmolding step, with the conductors 376, 478 being severed between overmolding steps.

The header power contact 138 of the "A" type lead frame 377 has a length 484 measured from a carrier support 486. The header power contact 138 of the "B" type lead frame 477 has a length 488 measured from a carrier support 486. The length 488 may be shorter than the length 484. As such, the header power contact 138 of the "A" type lead frame 377 may mate with the corresponding power contact 276 of the receptacle assembly 102 prior to the header power contact 138 of the "B" type lead frame 477.

The conductors 376, 478 associated with the header power contacts 138 define power conductors 490, 492, respectively. The power conductors 490, 492 are wider than the conductors 376, 478 that carry the data signals. The width of the power conductors 490, 492 may be selected based on the amount of power transmitted therethrough. For example, the power conductors 490, 492 may be wider for higher voltage or current applications or may be narrower for lower voltage or current applications. The power conductors 490, 492 may be wider for better heat dissipation. Additionally, the contact module bodies 370, 460 (shown in FIGS. 7 and 8, respectively) may have voids exposing portions of the power conductors 490, 492 for heat dissipation.

In an exemplary embodiment, multiple contact tails 494, 496 extend from each of the power conductors 490, 492, respectively. Multiple contact tails 494, 496 are provided to provide multiple connection points with the circuit board 108 (shown in FIG. 1). As such, more power may be transferred across the interface between the contact tails 494, 496 and the circuit board 108. For example, higher current or higher voltage may be transferred across the interface.

Figure 11:
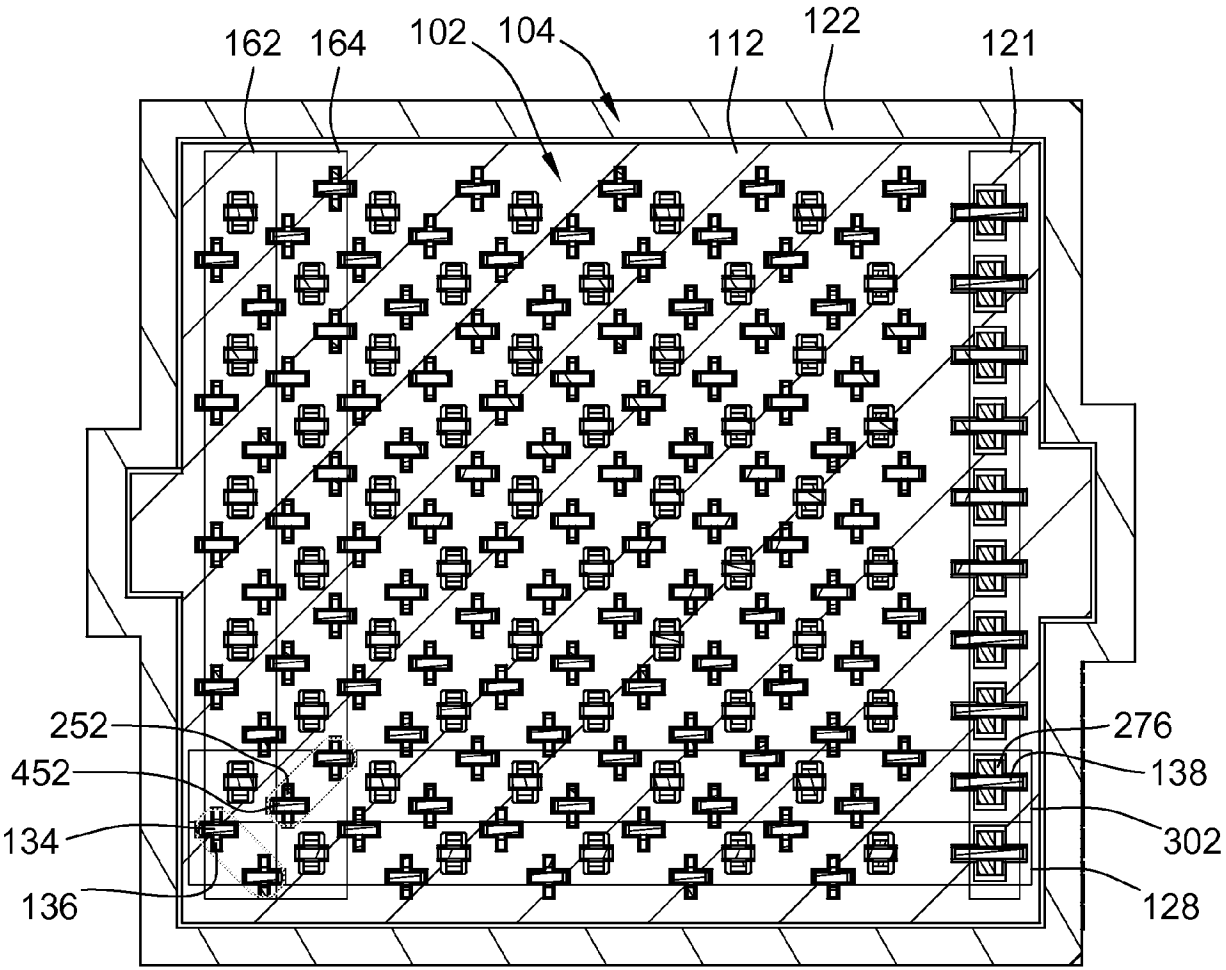
FIG. 11 illustrates a section of the receptacle assembly and header assembly in a mated position through the mating interfaces thereof.

FIG. 11 illustrates a section of the receptacle assembly 102 and header assembly 104 in a mated position through the mating interfaces thereof. FIG. 11 also illustrates in phantom an outline of an "A" type contact module 162 and a "B" type contact module 164 of the receptacle assembly 102 and an outline of an "A" type contact module 128 and a "B" type contact module 302 of the header assembly 102. The receptacle contact modules 162, 164 are oriented orthogonal with respect to the header contact modules 128, 302. Each of the signal pairs are illustrated by oval phantom lines surrounding the corresponding mating contacts 134, 136 and 252, 452.

FIG. 11 also illustrates in phantom an outline of the power contact module 121 of the receptacle assembly 102. The power contact module 121 is oriented orthogonal to the header contact modules 128, 302. The power contacts 276 engage the header power contacts 138 of each of the header contact modules 128, 302. As such, power is transferred to the power contact module 121 from each header contact module 128, 302. The power interface between the power contacts 276 and the header power contacts 128 is defined within the perimeter of the housings 112, 122.

Figure 12:
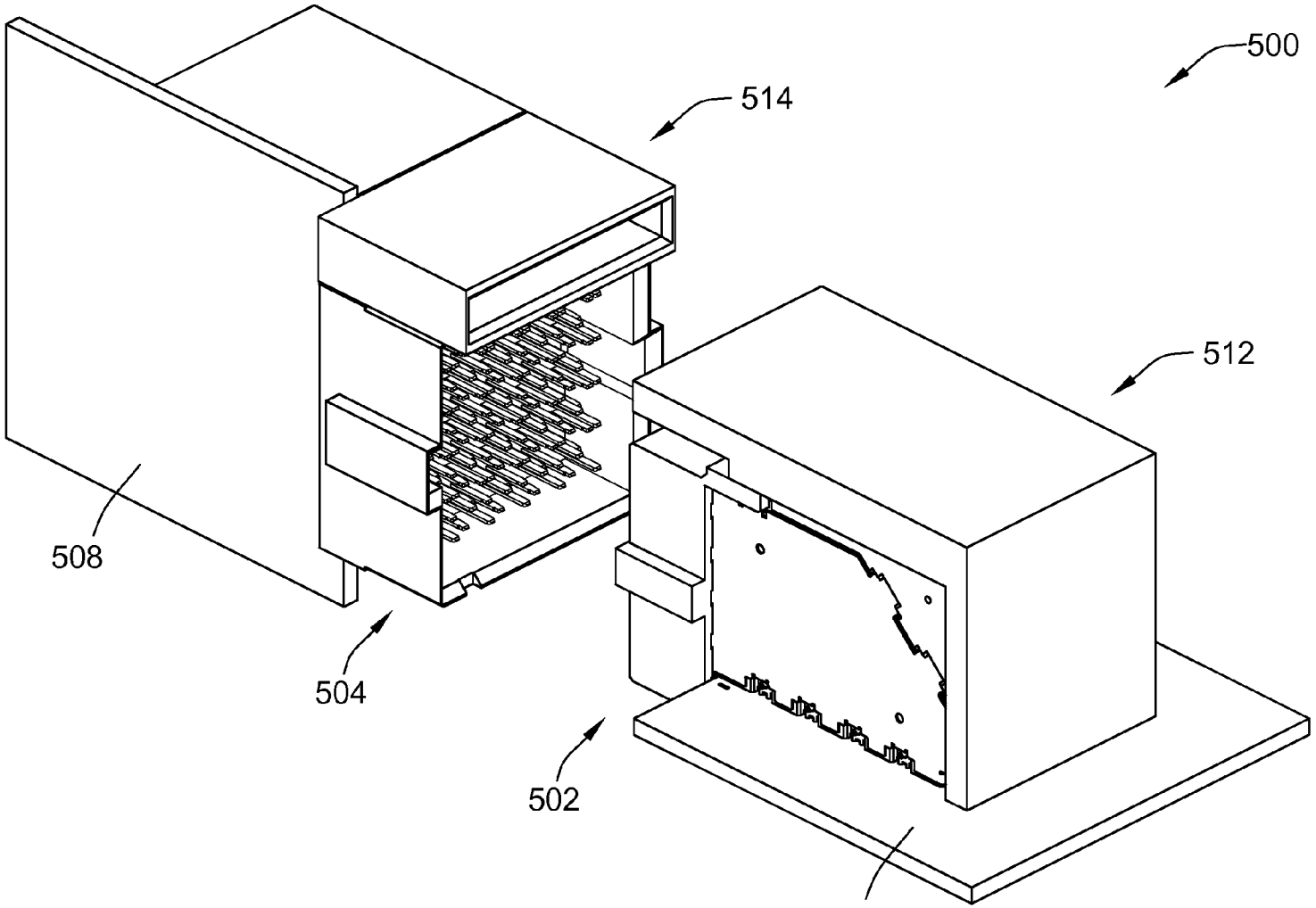
FIG. 12 is a perspective view of an orthogonal connector system formed in accordance with an alternative embodiment illustrating a receptacle assembly and a header assembly in unmated positions.

FIG. 12 is a perspective view of an orthogonal connector system 500 formed in accordance with an alternative embodiment illustrating a receptacle assembly 502 and a header assembly 504 in unmated positions. The connector assemblies 502, 504 are each directly connected to first and second circuit boards 506, 508, respectively. A receptacle power contact module 512 is attached to the receptacle assembly 502 and a header power contact module 514 is attached to the header assembly 504. The power contact modules 512, 514 are configured to transfer power between the first and second circuit boards 506, 508.

In an exemplary embodiment, the receptacle and header assemblies 502, 504 only include signal and ground conductors and contacts that are coupled to one another. The receptacle and header assemblies 502, 504 do not have any power conductors or power contacts. Rather, the power contact modules 512, 514 are used to transfer power between the circuit boards 506, 508. The receptacle and header assemblies 502, 504 may be substantially similar to the receptacle and header assemblies described in U.S. patent application titled ORTHOGONAL. CONNECTOR SYSTEM, having Ser. No. 12/353,550, which has been incorporated by reference. Alternatively, the receptacle and header assemblies 502, 504 may be other types of direct connect type connector assemblies used to interconnect the circuit boards 506, 508.

The receptacle power contact module 512 is separate and distinct from the receptacle assembly 502 and coupled thereto. The receptacle power contact module 512 may be coupled to the receptacle assembly 502 such that the receptacle power contact module 512 abuts against the housing of the receptacle assembly 502. The receptacle power contact module 512 may be held by the housing of the receptacle assembly 502 prior to mounting to the circuit board 506 such that the receptacle power contact module 512 and the receptacle assembly 502 may be simultaneously mounted to the circuit board 506. When the receptacle power contact module 512 abuts against the receptacle assembly 502, the assembly has an outer perimeter defining a housing 516. The housing 516 is a two part housing that may or may not be fixedly secured to one another. The receptacle power contact module 512 and the receptacle assembly 502 are mounted to the circuit board 506 to define a unit and cooperate with one another to transmit power and data as an electrical connector unit.

The header power contact module 514 is separate and distinct from the header assembly 504 and coupled thereto. The header power contact module 514 may be coupled to the header assembly 504 such that the header power contact module 514 abuts against the housing of the header assembly 504. The header power contact module 514 may be held by the housing of the header assembly 504 prior to mounting to the circuit board 508 such that the header power contact module 514 and the header assembly 504 may be simultaneously mounted to the circuit board 508. When the header power contact module 514 abuts against the header assembly 504, the assembly has an outer perimeter defining a housing 518. The housing 518 is a two part housing that may or may not be fixedly secured to one another. The header power contact module 514 and the header assembly 504 are mounted to the circuit board 508 to define a unit and cooperate with one another to transmit power and data as an electrical connector unit.

The power contact modules 512, 514 may be directly connected to one another. The power contact modules 512, 514 may be connected to one another simultaneously with the receptacle and header assemblies 502, 504. Optionally, either the power contact modules 512, 514 may be mated first or the connector assemblies 502, 504 may be mated first during the mating process, such as by a sequenced mating process.

In the illustrated embodiment, the receptacle power contact module 512 extends along a top and rear of the receptacle assembly 502 such that the receptacle power contact module 512 may be electrically connected to the first circuit board 506. The header power contact module 514 extends along a side of the header assembly 504 such that the header power contact module 514 may be electrically connected to the second circuit board 508. Other configurations are possible in alternative embodiments. For example, in an alternative embodiment, the power interfaces may be reversed from the arrangement illustrated in FIG. 12. For example, a power contact module similar to the header power contact module 514 may extend along the side of the receptacle assembly 502. A power contact module similar to the receptacle power contact module 512 may extend along the top and rear of the header assembly 504.

Figure 13:
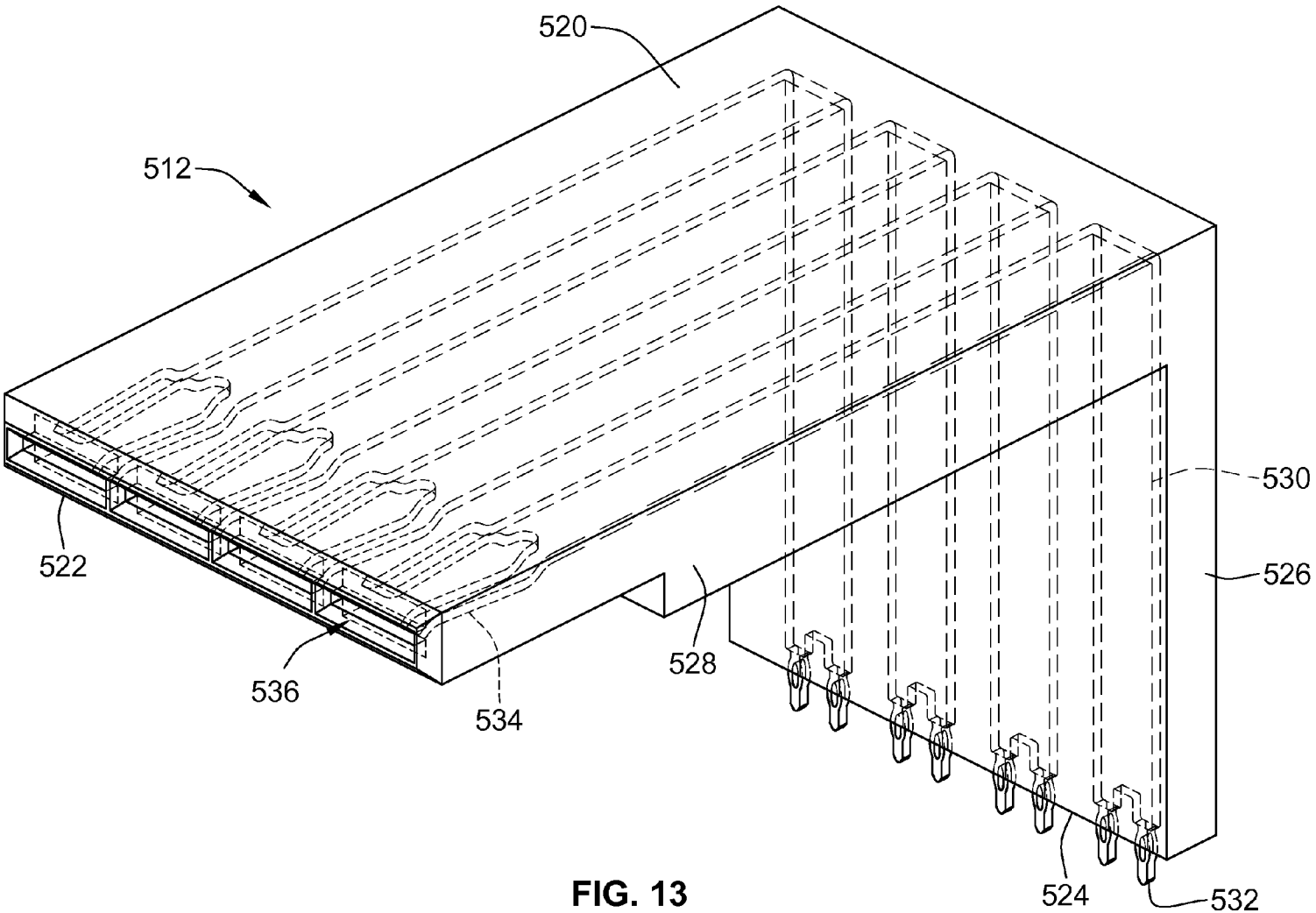
FIG. 13 is a front perspective view of a power contact module for the receptacle assembly shown in FIG. 12.

FIG. 13 is a front perspective view of the receptacle power contact module 512 for the receptacle assembly 502 (shown in FIG. 12). The power contact module 512 includes a contact module body 520 extending between a mating end 522 at a front of the body 520 and a mounting end 524 at a bottom of the body 520. The mating and mounting ends 522, 524 are orthogonal to one another. The mating end 522 is mated with the header power contact module 514 (shown in FIG. 12). The mounting end 524 is mounted to the first circuit board 506 (shown in FIG. 12). The contact module body 520 is L-shaped with a rear portion 526 that extends along the rear of the receptacle assembly 502 and a top portion 528 that extends along the top of the receptacle assembly 502.

The receptacle power contact module 512 includes power conductors 530 (shown in phantom) that extend between the mating and mounting ends 522, 524. Optionally, the power conductors 530 may be right angle conductors that transition approximately 90° between the mating and mounting ends 522, 524. Any number of power conductors 530 may be provided. In the illustrated embodiment, four power conductors 530 are provided. The power conductors 530 are arranged along a mating plane that is parallel to the first circuit board 506. The power conductors 530 include power tails 532 at one end thereof and power contacts 534 at the opposite end thereof. The power tails 532 may be terminated to the first circuit board 506. The power contacts 534 define a mating interface for the header power contact module 504. Slots 536 are provided at the mating end 522 that provide access to the power contacts 534 for a portion of the header power contact module 504. The power contacts 534 and power tails 532 may be integrally formed with the power conductor 530, where the power contacts 534 and power tails 532 are portions of the power conductor 530.

Figure 14:
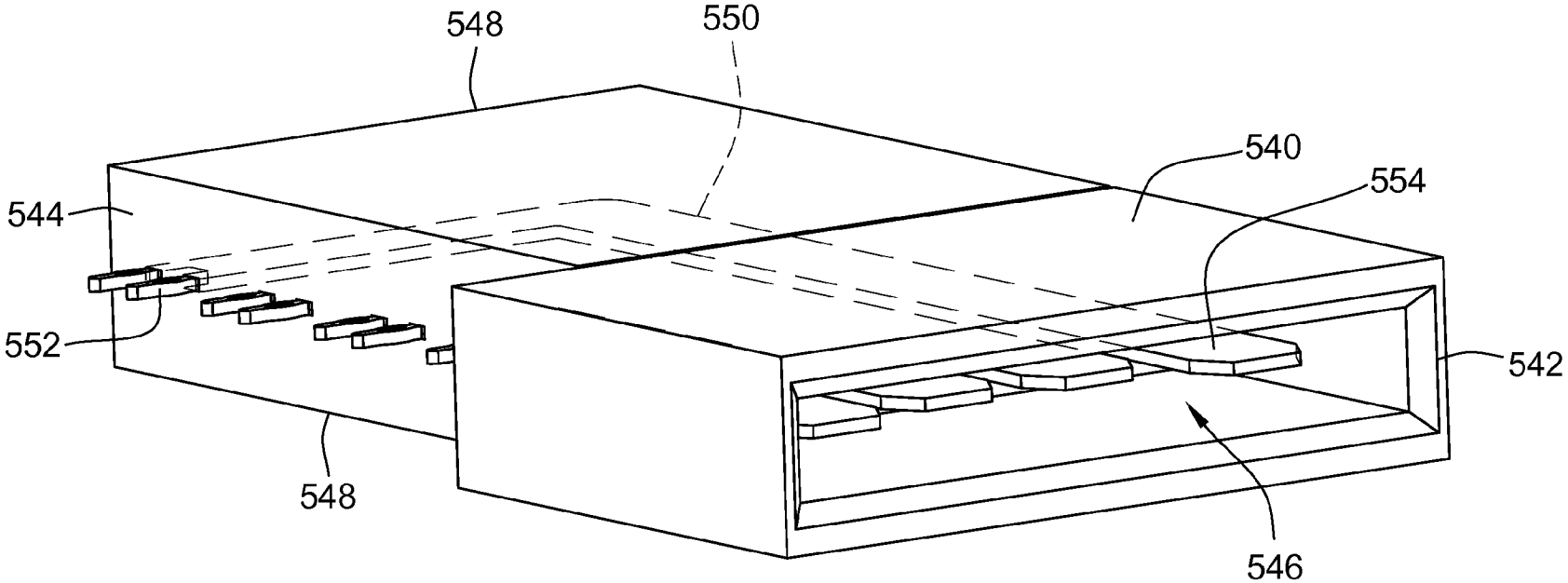
FIG. 14 is a front perspective view of a power contact module for the header assembly shown in FIG. 12.

FIG. 14 is a front perspective view of the header power contact module 514 for the header assembly 504 (shown in FIG. 12). The power contact module 514 includes a contact module body 540 extending between a mating end 542 at a front of the body 540 and a mounting end 544 at a bottom of the body 540. The mating and mounting ends 542, 544 are orthogonal to one another. The mating end 542 includes a slot 546 that receives the front of the receptacle power contact module 512 (shown in FIG. 12). The mounting end 544 is mounted to the second circuit board 508 (shown in FIG. 12). The contact module body 540 is rectangular in shape and extends between opposed sides 548. One of the sides 548 extends along a side of the header assembly 504 when the power contact module 514 is coupled to the second circuit board 508.

The receptacle power contact module 512 includes power conductors 550 that extend between the mating and mounting ends 542, 544. Optionally, the power conductors 550 may be right angle conductors that transition approximately 90° between the mating and mounting ends 542, 544. Any number of power conductors 550 may be provided. In the illustrated embodiment, four power conductors 550 are provided. The power conductors 550 are arranged along a mating plane that is perpendicular to the second circuit board 508. The power conductors 550 include power tails 552 at one end thereof and power contacts 554 at the opposite end thereof. The power tails 552 may be terminated to the second circuit board 508. The power contacts 554 define a mating interface for the power contacts 534 (shown in FIG. 13) of the receptacle power contact module 502. The power contacts 554 are received in the slots 536 (shown in FIG. 13) for mating with the power contacts 534. The power contacts 554 and power tails 552 may be integrally formed with the power conductor 550, where the power contacts 554 and power tails 552 are exposed portions of the power conductor 550. The contact module body 540 may be overmolded around the power conductors 550. Alternatively, the power conductors 550 may be received with the contact module body 540 and held therein. For example, the contact module body 540 may be split in two halves that are coupled together after the power conductors 550 are positioned therebetween.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An orthogonal connector system for connecting a first circuit board and a second circuit board oriented orthogonally with respect to the first circuit board, the orthogonal connector system comprising:

a receptacle assembly and a header assembly mated with the receptacle assembly, the receptacle assembly being connected to the first circuit board and the header assembly being connected to the second circuit board, the receptacle assembly and the header assembly both have a housing and contact modules held by the corresponding housing, each contact module having a dielectric body and conductors therein, the conductors being coplanar within the dielectric body, the conductors having mating contacts extending from the dielectric body;

wherein the mating contacts of the receptacle assembly are directly connected to the mating contacts of the header assembly;

wherein at least some of the conductors of the receptacle assembly define power conductors configured to transmit power and at least some of the conductors of the header assembly define power conductors configured to be mated with the power contacts of the receptacle assembly; and wherein the conductors of the contact modules of the receptacle assembly include both power conductors and signal conductors being coplanar within the corresponding dielectric body.

2. The system of claim 1, wherein the contact modules of the receptacle assembly are oriented orthogonal with respect to the contact modules of the header assembly.

3. The system of claim 1, wherein each contact module of the header assembly includes at least one power contact.

4. The system of claim 1, wherein at least one of the contact modules of the receptacle assembly defines a power contact module having each mating contact thereof being a power contact.

5. The system of claim 1, wherein the mating contacts are arranged in rows and columns, the rows being parallel to the respective first and second circuit boards, the columns being perpendicular to the respective first and second circuit boards, the mating contacts of each contact module being arranged in the same column, the power contacts of the receptacle assembly being arranged in the same column, the power contacts of the header assembly being arranged in the same row.

6. The system of claim 1, wherein the power contacts of the receptacle assembly extend along a power contact axis from the dielectric body to a tip, the power contacts having jogged sections such that the power contacts are non-planar along the power contact axis.

7. The system of claim 1, wherein adjacent mating contacts of each contact module are offset with respect to one another such that adjacent mating contacts are not aligned with one another.

8. The system of claim 1, wherein the contact modules of the receptacle assembly are each aligned with one another along parallel receptacle assembly contact module planes, the contact modules of the header assembly are each aligned with one another along parallel header assembly contact module planes, the receptacle assembly contact module planes are perpendicular to the header assembly contact module planes.

9. The system of claim 1, wherein the contact modules of the receptacle assembly are each aligned with one another along parallel receptacle assembly contact module planes, the contact modules of the header assembly are each aligned with one another along parallel header assembly contact module planes, the receptacle assembly contact module planes are parallel to the second circuit board and the header assembly contact module planes are parallel to the first circuit board.

10. The system of claim 1, wherein at least one of the contact modules of the receptacle assembly define a power contact module and at least one of the contact modules of the header assembly define a power contact module, the power contact modules being separate and distinct from the housings and mountable to the corresponding circuit boards adjacent to the housings.

11. A connector assembly for an orthogonal connector system used to interconnect circuit boards oriented orthogonally with respect to one another, the connector assembly comprising:

a housing having a mating face; and contact modules held within the housing, the contact modules each have a contact module body including a mating edge and a mounting edge that is orthogonal to the mating edge, the contact modules each have conductors held by the corresponding contact module body along a conductor plane, the contact module body being overmolded over the conductors, contact tails extend from the conductors at the mounting edge for connection to a circuit board, mating contacts extend from the conductors at the mating edge for mating with corresponding mating contacts of a corresponding mating connector assembly;

wherein at least one conductor of each contact module defines a power conductor configured to transmit power and at least one conductor of each contact module defines a signal contact configured to transmit data signals, the power conductor and signal contact being comolded in the contact module body.

12. The connector assembly of claim 11, wherein the contact modules are held within the housing such that each of the power conductors are aligned with one another.

13. The connector assembly of claim 11, wherein the power conductor and signal conductors of each contact module are formed from a common lead frame being overmolded by the contact module body.

14. The connector assembly of claim 11, wherein the mating contacts are arranged in rows and columns, the columns being parallel to the conductor planes, the rows being perpendicular to the conductor planes, the mating contacts of each contact module being arranged in the same column, the mating contacts extending from the power conductors defining power contacts, the power contacts being arranged in the same row.

15. The connector assembly of claim 11, wherein the mating contacts extending from the power conductors define power contacts, the contact modules being held within a housing such that the power contacts of adjacent contact modules are aligned with one another along a power plane perpendicular to the conductor planes.

16. The connector assembly of claim 11, wherein the power conductors have a first width, the signal conductors have a second width that is narrower than the first width.

17. An orthogonal connector system for connecting a first circuit board and a second circuit board oriented orthogonally with respect to the first circuit board, the orthogonal connector system comprising:

a first connector assembly being connected to the first circuit board, the first connector assembly having a first connector housing, a plurality of signal contact modules held by the first connector housing, and a power contact module held by the housing, the signal contact modules having a dielectric body and first connector contacts extending from the dielectric body, the power contact module having a dielectric body and power contacts extending from the dielectric body; and a second connector assembly mated with the first connector assembly, the second connector assembly being connected to the second circuit board, the second connector assembly having a second connector housing and second connector contact modules held by the second connector housing, each second connector contact module having a dielectric body, the second connector contact module having second connector contacts overmolded by, and extending from the dielectric body and the second connector contact module having power contacts overmolded by, and extending from the dielectric body;

wherein the first connector contacts are directly connected to corresponding second connector contacts, and wherein the power contacts of the second connector contact modules are directly connected to corresponding power contacts of the power contact module, the power contact module being oriented orthogonal to the second connector contact modules.

18. The system of claim 17, wherein the mating contacts are arranged in rows and columns, the rows being parallel to the respective first and second circuit boards, the columns being perpendicular to the respective first and second circuit boards, the mating contacts of each contact module being arranged in the same column, the power contacts of the first connector assembly being arranged in the same column, the power contacts of the second connector assembly being arranged in the same row.

19. The system of claim 17, wherein the second connector contact modules extend along parallel second connector planes, the signal contact modules and power contact module extend along parallel first connector planes, the second connector assembly being mated with the first connector assembly such that the second connector planes are orthogonal to the first connector planes.

20. The system of claim 17, wherein the power contacts of the first connector assembly extend along a power contact axis from the dielectric body to a tip, the power contacts having jogged sections such that the power contacts are non-planar along the power contact axis.

21. The system of claim 17, wherein the second connector contact modules are held within the second connector housing such that each of the power contacts are aligned with one another along a second connector power plane, the second connector power plane extending perpendicular to the second connector contact modules.

22. An orthogonal connector system for connecting a first circuit board and a second circuit board oriented orthogonally with respect to the first circuit board, the orthogonal connector system comprising:

a receptacle assembly and a header assembly mated with the receptacle assembly, the receptacle assembly being connected to the first circuit board and the header assembly being connected to the second circuit board, the receptacle assembly and the header assembly both have a housing and contact modules received in and held by the corresponding housing, the housings having outer surfaces, each contact module having a dielectric body and mating contacts extending from the dielectric body, the mating contacts of the receptacle assembly being directly connected to the mating contacts of the header assembly;

a receptacle power contact module having a plurality of power contacts, the receptacle power contact being configured to be connected to the first circuit board adjacent to the receptacle assembly, the receptacle power contact module engaging the outer surface of the housing of the receptacle assembly; and a header power contact module having a plurality of power contacts, the header power contact being configured to be connected to the second circuit board adjacent to the header assembly, the header power contact module engaging the outer surface of the housing of the header assembly, the power contacts of the header assembly being directly connected to the power contacts of the receptacle assembly.

23. The system of claim 22, wherein the receptacle assembly includes a top opposite a mounting face of the receptacle assembly, a rear opposite a mating face of the receptacle assembly, and opposite sides, and wherein the header assembly includes a top opposite a mounting face of the receptacle assembly, a rear opposite a mating face of the receptacle assembly, and opposite sides, one of the receptacle power contact module and the header power contact module extending along one of the sides of the corresponding receptacle assembly and header assembly, the other of the receptacle power contact module and the header power contact module extending along the rear and the top of the corresponding receptacle assembly and header assembly.

24. The system of claim 22, wherein the power contacts include mating portions that engage one another, the mating portions of one of the receptacle power contact module and the header power contact module extending along a mating plane that is parallel to the corresponding circuit board, the mating portions of the other of the receptacle power contact module and the header power contact module extending along a mating plane that is perpendicular to the corresponding circuit board.

* * * * *